US008854353B2

(12) United States Patent
Chung

(10) Patent No.: US 8,854,353 B2
(45) Date of Patent: Oct. 7, 2014

(54) SCAN DRIVER AND DISPLAY DEVICE COMPRISING THE SAME

(75) Inventor: Bo-Yong Chung, Yongin (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 319 days.

(21) Appl. No.: 13/238,167

(22) Filed: Sep. 21, 2011

(65) Prior Publication Data

US 2012/0105423 A1 May 3, 2012

(30) Foreign Application Priority Data

Oct. 28, 2010 (KR) ..... 10-2010-0106274

(51) Int. Cl.
*G09G 5/00* (2006.01)

(52) U.S. Cl.
CPC ..... *G09G 5/00* (2013.01)
USPC ..... 345/212; 345/204

(58) Field of Classification Search
CPC . G09G 3/3696; G09G 3/3688; G09G 3/3648; G09G 5/00
USPC ..... 345/212, 204
See application file for complete search history.

(56) References Cited

U.S. PATENT DOCUMENTS

| | | | | |
|---|---|---|---|---|
| 2004/0227718 | A1* | 11/2004 | Park | 345/100 |
| 2010/0158187 | A1* | 6/2010 | Moon et al. | 377/76 |
| 2011/0285752 | A1* | 11/2011 | Park et al. | 345/690 |
| 2012/0013588 | A1* | 1/2012 | Chung | 345/211 |
| 2012/0081409 | A1* | 4/2012 | Chung | 345/690 |

FOREIGN PATENT DOCUMENTS

| | | |
|---|---|---|
| KR | 10-0666637 | 1/2007 |
| KR | 10-2007-0022550 | 2/2007 |
| KR | 10-0719667 | 5/2007 |
| KR | 10-0762690 | 9/2007 |

* cited by examiner

*Primary Examiner* — Lixi C Simpson
(74) *Attorney, Agent, or Firm* — Robert E. Bushnell, Esq.

(57) ABSTRACT

A scan driver and a display device including the same. The scan driver includes a plurality of shift registers including an input signal terminal into which an initial signal or an output signal of a previous stage is inputted, two clock signal terminals to which 2 phase clock signals are transferred, two control signal terminals to which a first control signal and a second control signal controlling a driving mode of simultaneously driving or sequentially driving output signals of all stages are transferred, and output signals terminals from which the output signals are outputted, wherein in the sequential driving mode, the first control signal and the second control signal are transferred as a predetermined first level voltage and in the simultaneous driving mode, the first control signal and the second control signal are transferred alternately as the first level voltage and a predetermined second level voltage.

36 Claims, 9 Drawing Sheets

SCAN DRIVER AND DISPLAY DEVICE COMPRISING THE SAME

CLAIM OF PRIORITY

This application makes reference to, incorporates the same herein, and claims all benefits accruing under 35 U.S.C. §119 from an application earlier filed in the Korean Intellectual Property Office on Oct. 28, 2010, and there duly assigned Serial No. 10-2010-0106274 by that Office.

BACKGROUND OF THE INVENTION

1. Field of the Invention

The present invention relates to a scan driver and a display device comprising the same. More particularly, the present invention relates to a scan driver that can be applied to both a sequential light emitting driving mode and a simultaneous light emitting driving mode of a display device and can operate at high speed in a large-sized panel having a large load while reducing the number of clocks and simplifying a configuration of components, and a display device using the same.

2. Description of the Related Art

In recent years, various flat panel displays capable of reducing weight and volume which are demerits of a cathode ray tube have been developed. The flat panel displays include a liquid crystal display (LCD), a field emission display (FED), a plasma display panel (PDP), and an organic light emitting diode (OLED) display.

Among the flat panel displays, the organic light emitting diode (OLED) display, which displays an image by using an organic light emitting diode generating light by recombination of electrons and holes, is driven at low power consumption while having a rapid response speed and is excellent in emission efficiency, luminance, and viewing angle.

In the flat panel display, a display panel is formed by arranging a plurality of pixels on a substrate in a matrix, a data signal is selectively transferred to the pixel by connecting a scan line and a data line to each pixel, and an image is displayed by controlling emission by using an emission control signal transferred through an emission control line connected to each pixel.

In recent years, as the display panel has a large size, a clear screen quality of a high definition has been required and as a 3D (3-Dimensional) stereoscopic image display has been generally used, a driving circuit of a display device which has a clear image quality and is advantageous in implementing a 3D moving picture display has been actively researched and developed.

Since a scan driver required in the display device is driven with a large load in order to drive a large-sized panel and driven at a high speed in order to implement a 3D, and outputs output signals at a two-time horizontal cycle (2H) or more as a duty rate of the output signals in order to improve a compensation capability of the pixel, it requires an overlap output of a driving signal. Meanwhile, it is necessary to research and develop a configuration of elements to output the output signal depending on an operation mode of the display panel and simplify an interface to prevent a circuit configuration from being complicated and a circuit design using a clock signal in order to increase the efficiency of the scan driver used in the display device.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a scan driver which variously operates selectively in response to a simultaneous or sequential light emitting mode of a display device having advantages of improving a screen quality and excellently improving implementation of a 3D stereoscopic image display.

Further, the present invention has been made in an effort to provide a scan driver which can be applied to a single MOS process of a PMOS transistor or an NMOS transistor, develop a circuit structure of a scan driver having a simplified interface by reducing the numbers of circuit elements and input clocks, and provide a scan driver of a driving signal having a duty rate to be arbitrarily adjusted and which is implemented at diversified timings and can be overlapped.

The technical problems achieved by the present invention are not limited to the foregoing technical problems. Other technical problems, which are not described, can clearly be understood by those skilled in the art from the following description of the present invention.

An exemplary embodiment of the present invention provides a scan driving including a plurality of shift registers including an input signal terminal into which an initial signal or an output signal of a previous stage is inputted, two clock signal terminals to which 2 phase clock signals are transferred, two control signal terminals to which a first control signal and a second control signal controlling a driving mode of simultaneously driving or sequentially driving output signals of all stages are transferred, and output signals terminals from which the output signals are outputted.

In this case, in the sequential driving mode, the first control signal and the second control signal are transferred as a predetermined first level voltage and in the simultaneous driving mode, the first control signal and the second control signal are transferred alternately as the first level voltage and a predetermined second level voltage.

That is, in the simultaneous driving mode, the first control signal and the second control signal may not be overlapped with each other and transferred to the control signal terminals while shifting to a voltage between the first level and the second level.

The first level voltage may be in a gate off voltage level and the second level voltage may be in a gate on voltage level.

According to a type of circuit elements constituting the scan driver or the display device comprising the same, the gate off voltage may be a high-level voltage and available in an opposite case thereto. When the circuit element is a PMOS transistor, the gate off voltage may be a high-level voltage and when the circuit element is an NMOS transistor, the gate off voltage may be a low-level voltage. The gate on voltage may be opposite thereto.

In the simultaneous driving mode of the scan driver of the present invention, signals transferred to the input signal terminal and the clock signal terminal may be voltages having the gate off level.

When duty rates of the output signals of the scan driver of the present invention are outputted with an n-time horizontal cycle (n×H), the number of the clock signals is 2n. For example, when the duty rate of the output signal of the scan driver according to the exemplary embodiment of the present invention is set to a three-time horizontal cycle (3H), the number of clocks signals transferred to the clock signal terminal of the scan driver is 6 (=2×3).

In this case, the output signals of the scan driver are overlapped with each other by an n−1-time horizontal cycle (n−1×H). Accordingly, in the exemplary embodiment, the output signals are outputted while being overlapped with each other at a two-time horizontal cycle (1H) which is the duty rate of the output signals outputted from stages of the scan driver.

Further, when the output signals are outputted at an n-time horizontal cycle (n×H) which is the duty rate of the output signals of the scan driver of the present invention, the initial signal is transferred to an input signal terminal of a shift register of a first stage and thereafter, an output signal of the shift register of the corresponding stage is transferred to an input signal terminal of a shift register of a subsequent stage.

However, as another exemplary embodiment, the initial signal may be transferred to input signal terminals of shift registers of first n stages. For example, when the duty rate of the output signals is 3H, the initial signal is transferred to input signal terminals of shift registers of first three stages. Further, the output signal of the previous stage is transferred to each of input signal terminals of shift registers of subsequent stages. Herein, the previous stage is not a stage just prior to the corresponding stage but a corresponding stage among stages positioned above the corresponding stage. That is, in the exemplary embodiment, when the duty rate of the output signal is 3H, in the case where the corresponding stage is a fourth stage, a shift register of the fourth stage may receive the output signal outputted from the shift register of the first stage which is a third previous stage at an input signal terminal thereof.

In the scan driver of the present invention, two clock signals transferred to two clock signal terminals may have a phase difference from each other by a half cycle. Two clock signals may be 2 phase clock signals which are transferred while their phases are inverted to each other.

In the scan driver of the present invention, the first level voltage may be a high-level voltage and the second level voltage may be a low-level voltage. However, the voltages are not limited thereto and the voltages may be set according to a type constituting the circuit element.

In the present invention, the shift register may include: a first transistor transferring a voltage corresponding to the initial signal or the output signal of the previous stage when being turned on in response to a first clock signal; a second transistor transferring a first power supply voltage as the output signal of the sequential driving mode when being turned on in response to the first clock signal; a third transistor transferring a voltage depending on a second clock signal as the output signal of the sequential driving mode when being turned on by receiving the voltage corresponding to the initial signal or the output signal of the previous stage; a fourth transistor transferring the first power supply voltage as the output signal of the simultaneous driving mode when being turned on in response to the first control signal; a fifth transistor transferring a second power supply voltage having a voltage value lower than the first power supply voltage when being turned on in response to the second control signal; and a sixth transistor transferring the second power supply voltage as the output signal of the simultaneous driving mode when being turned on by receiving the second power supply voltage.

The shift register may further include: a first capacitor connected between a gate terminal and a drain terminal of the third transistor; and a second capacitor connected between a gate terminal and a drain terminal of the sixth transistor.

The shift register may further include at least two transistors connected between a first power supply to which the first power supply voltage is applied and a first node connected to a drain terminal of the first transistor and the gate terminal of the third transistor.

In this case, the two transistors may be a seventh transistor transferring the first power supply voltage to the first node when being turned on in response to the first control signal and an eighth transistor transferring the first power supply voltage to the first node when being turned on in response to the second control signal.

The shift register may further include at least one ninth transistor transferring the first power supply voltage to the gate terminal of the sixth transistor when being turned on in response to the first control signal.

Further, the shift register may further include at least one tenth transistor transferring the first power supply voltage to the gate terminal of the sixth transistor when being turned on in response to any one signal of the first clock signal, the second clock signal, and a predetermined third control signal. In particular, the plurality of shift registers of the scan driver generate the output signals in the simultaneous driving mode and thereafter, the tenth transistor is turned on just before the simultaneous driving mode is switched to the sequential driving mode to transfer a voltage having the gate off level to the gate terminal of the sixth transistor, thereby stably turning off the sixth transistor. In this case, a contact where the drain terminal of the sixth transistor and the drain terminal of the fourth transistor are connected with each other is electrically floated to stably generate and transfer the output signal in the sequential driving mode.

In the present invention, the shift register generates the output signal as a pulse of a voltage level depending on the first power supply voltage or the second clock signal in the sequential driving mode to sequentially generate and output the output signals of all the stages.

Meanwhile, the shift register generates the output signal as a pulse of a voltage level depending on the first power supply voltage or the second power supply voltage in the simultaneous driving mode to generate and simultaneously output the output signals of all the stages.

A time when the voltage level of the output signal of the shift register is reversed in the sequential driving mode may be synchronized with a time when the third transistor turned on in response to the initial signal or the output signal of the previous stage transfers a gate on voltage of the second clock signal.

A time when voltage levels of all the output signals of the shift register are reversed in the simultaneous driving mode may be synchronized with a time when the voltage levels of the first control signal and the second control signal simultaneous shift.

A switching element included in the shift register may be a PMOS transistor or an NMOS transistor.

Another exemplary embodiment of the present invention provides a display device including: a display panel including a plurality of pixels connected to a plurality of scan lines to which a plurality of scan signals are transferred and a plurality of data lines to which a plurality of data signals are transferred; a scan driver generating and transferring the scan signal to a corresponding scan line among the plurality of scan lines; and a data driver transferring data signals to the plurality of data lines. In this case, the scan driver includes a plurality of shift registers including an input signal terminal into which an initial signal or an output signal of a previous stag is inputtede, two clock signal terminals to which 2 phase clock signals are transferred, two control signal terminals to which a first control signal and a second control signal controlling a driving mode of simultaneously driving or sequentially driving output signals of all stages are transferred, and output signals terminals from which the output signals are outputted. In the sequential driving mode, the first control signal and the second control signal are transferred as a predetermined first level voltage and in the simultaneous driving mode, the first control signal and the second control signal are transferred alternately as the first level voltage and a predetermined second level voltage.

According to exemplary embodiments of the present invention, it is possible to provide a scan driver which variously operates selectively depending on a driving mode and excellently improve implementation of a 3D stereoscopic image display by controlling a circuit configuration and a timing of a driving signal of the scan driver.

Meanwhile, according to exemplary embodiments of the present invention, it is possible to drive a display device by generating a driving signal having a duty rate which is arbitrarily adjusted and which can be implemented at diversified timings.

Further, it is possible to provide a product which can provide use convenience and diversity and is reliable, which can operate at high speed in a large-sized panel having a large load while reducing the number of clocks and simplifying a configuration of components.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
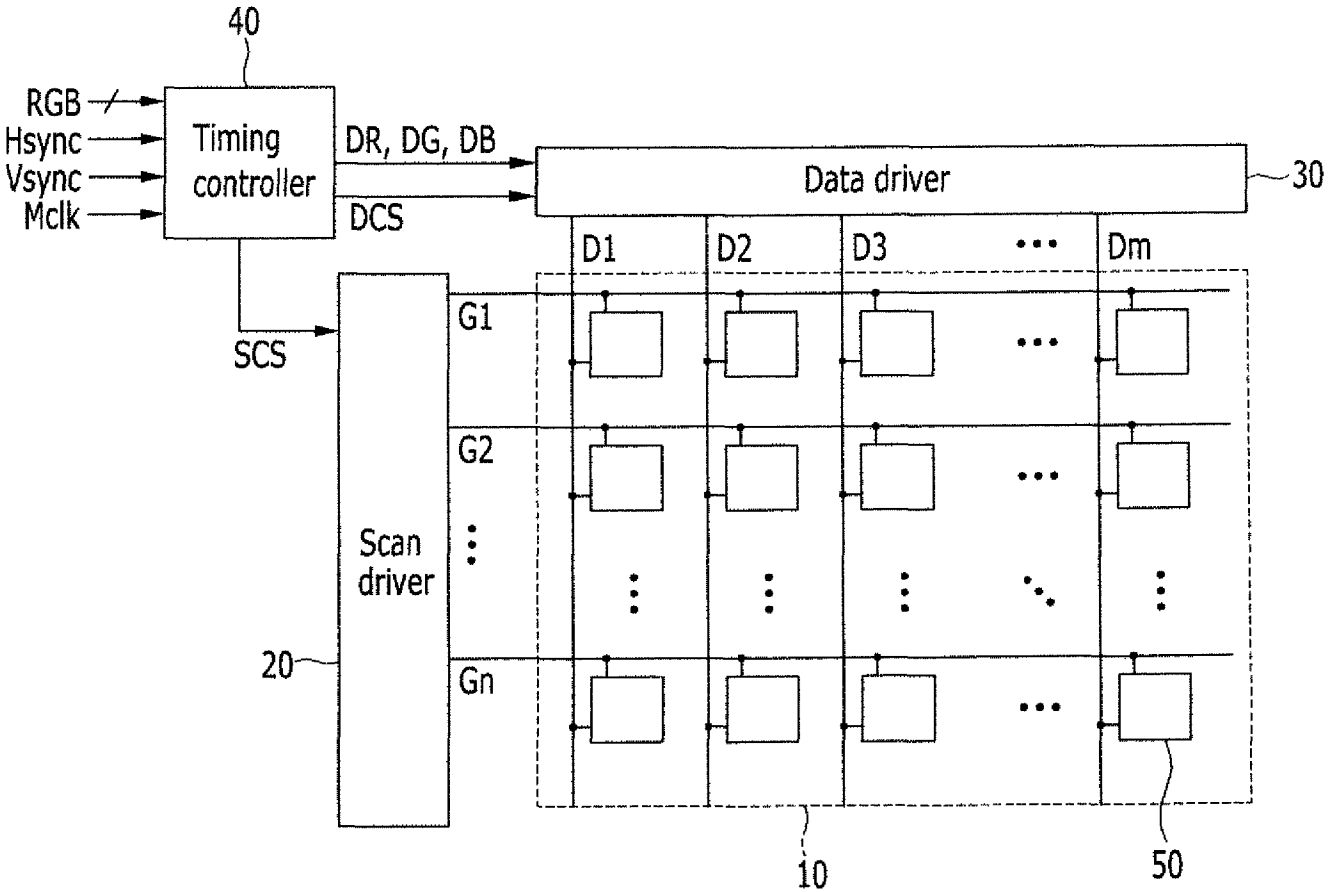
FIG. 1 is a block diagram of a display device according to an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

Further, in the exemplary embodiments, like reference numerals designate like elements throughout the specification representatively in a first exemplary embodiment and only elements other than those of the first exemplary embodiment will be described.

The drawings and description are to be regarded as illustrative in nature and not restrictive. Like reference numerals designate like elements throughout the specification.

In the specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising", will be understood to imply the inclusion of stated elements but not the exclusion of any other elements.

FIG. 1 is a block diagram of a display device according to an exemplary embodiment of the present invention.

Referring to FIG. 1, the display device includes a display panel 10, a scan driver 20, a data driver 30, a timing controller 40 and pixels 50. The display device, as a flat panel display, may be various types of display devices including a liquid crystal display, an organic light emitting display, and the like and is not particularly limited thereto.

In FIG. 1, the scan driver 20 generates scan signals for selecting and operating each of pixels 50 of the display panel 10 and transfers it to the display panel 10.

The display panel 10 includes a plurality of pixels 50 connected to corresponding scan lines among a plurality of scan lines G1 to Gn and corresponding data lines among a plurality of data lines D1 to Dm at regions which the plurality of scan lines G1 to Gn and the plurality of data lines D1 to Dm intersect each other.

The display panel 10 includes the plurality of pixels 50 that are arranged substantially in a matrix. In an arrangement form of the pixels 50, the plurality of scan lines transferring the scan signals extend substantially in a row direction and substantially in parallel to each other and the plurality of data lines extend substantially in a column direction and substantially in parallel to each other, but the present invention is not limited thereto.

In the case where the display device is the organic light emitting display, each of the plurality of pixels 50 included in the display panel 10 includes a driving transistor and an organic light emitting diode. In this case, the pixel 50 is selected from the plurality of pixels included in the display panel 10 by the scan signal transferred through the corresponding scan line among the plurality of scan lines G1 to Gn and the driving transistor included in the pixel 50 receives a data voltage depending on a data signal transferred through the corresponding data line among the plurality of data line D1 to Dm and supplies current depending on the data voltage to the organic light emitting diode to emit light having predetermined luminance.

Therefore, a circuit configuration of the scan driver and a driving waveform diagram driving the same according to an exemplary embodiment of the present invention are applied to the scan driver 20 of FIG. 1. The scan driver according to the detailed exemplary embodiment of the present invention will be described with respect to FIGS. 2 and 3.

Meanwhile, in FIG. 1, the scan driver 20 is connected with the plurality of scan lines G1 to Gn and generates the scan signals and transfers them to each of the scan lines G1 to Gn. A predetermined row is selected from a plurality of pixel rows of a predetermined display panel 10 by the scan signal and the data signal is transferred through the data line connected to each of the plurality of pixels positioned in the selected row.

The data driver 30 is connected with the plurality of data lines D1 to Dm and generates the data signals and sequentially transfers the data signals to each of the plurality of pixels included in one row among the plurality of pixel rows of the display panel 10 through each of the plurality of data lines D1 to Dm.

The timing controller 40 generates a scan driving control signal (SCS) and a driving control signal (DCS) controlling driving of the scan driver 20 and the data driver 30 by using a horizontal synchronization signal Hsync, a vertical synchronization signal Vsync, and a clock signal MCLK inputted from the outside. That is, the data driving control signal (DCS) generated by the timing controller 40 is provided to the data driver 30 and the scan driving control signal (SCS) is provided to the scan driver 20.

Figure 2:
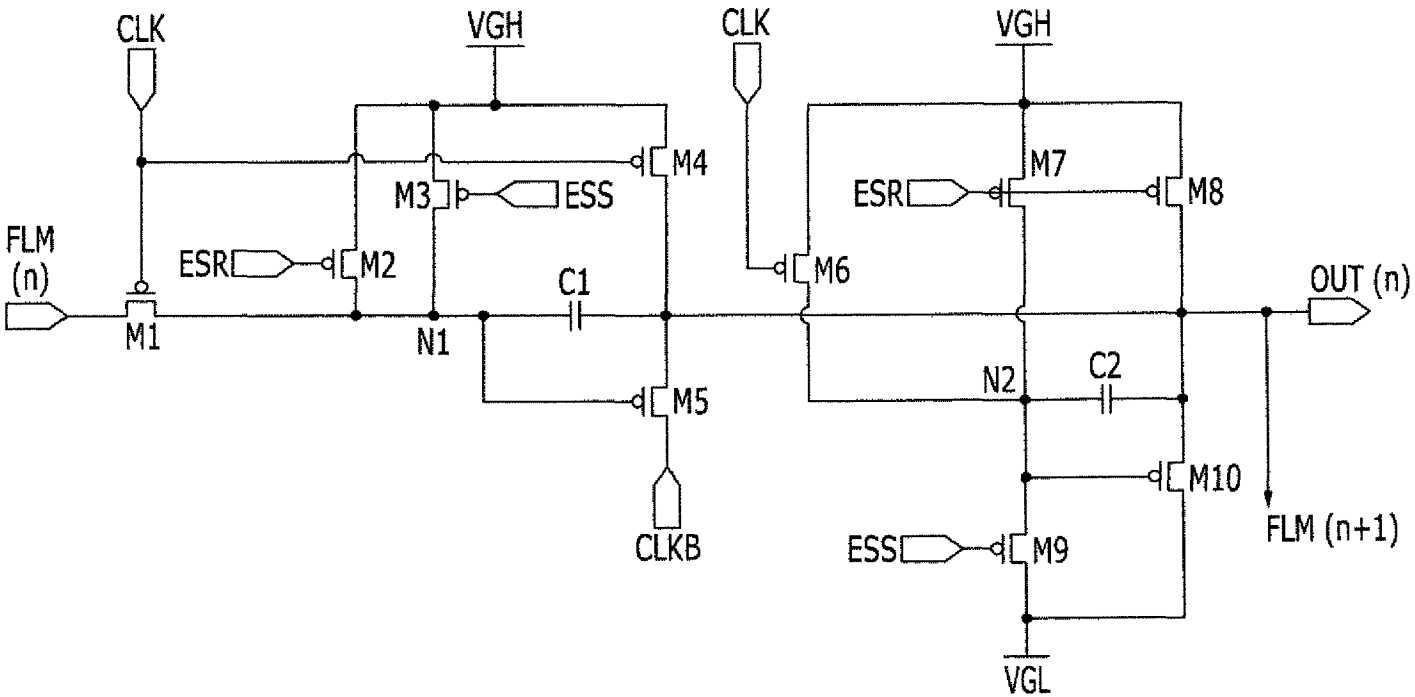
FIG. 2 is a circuit diagram of a scan driver according to an exemplary embodiment of the present invention.

FIG. 2 is a circuit diagram of a scan driver according to an exemplary embodiment of the present invention. The circuit diagram of FIG. 2 shows an n-th shift register SRn among a plurality of shift registers (SR1, SR2, SR3, SR4 . . . of FIG. 3) of the scan driver according to the exemplary embodiment of the present invention.

The scan driver of FIG. 2 includes one input signal terminal FLM(n), one output signal terminal OUT(n), two clock signal terminals CLK and CLKB, and two control signal terminals ESR and ESS, but the configuration of the scan driver is not necessarily limited thereto and the design of the scan driver may be easily modified.

An initial signal or an output signal outputted from a shift register of a previous stage may be inputted into the input signal terminal FLM(n).

The initial signal is inputted when the output signal cannot be received from the shift register of the previous stage.

The previous stage may indicate a stage just prior to the corresponding stage, but is not limited thereto and an output signal of a shift register of a corresponding stage among stages positioned above the shift register of the corresponding stage may be transferred.

A detailed input process of the initial signal and the output signal of the previous stage will be described in a block diagram to be described below.

Meanwhile, a driving signal generated from the shift register of the corresponding stage (n-th stage) is outputted from the output signal terminal OUT(n). That is, a scan signal generated by the shift register of the corresponding stage is outputted from the output signal terminal OUT(n).

The scan signal of the corresponding stage is transferred to an input signal terminal FLM(n+1) of a shift register of a subsequent stage on the basis of a circuit structure which is variously configured according to the exemplary embodiment. Herein, the subsequent stage may be a shift register connected just below the corresponding stage, but is not limited thereto and may be a shift register of a subsequent stage according to the circuit structure which is variously set depending on a duty rate of the output signal.

2 phase clock signals having different phase differences are inputted into two clock signal terminals CLK and CLKB, respectively. The 2 phase clock signals may be clock signals which are not overlapped with each other while having a phase difference as large as a half cycle.

The number of inputted clock signals may be adjusted according to the duty rate of the outputted driving signal and the number of the clock signals is an even number and a phase difference between clock signals which form a pair is a half cycle and the clock signals are not overlapped with each other.

Clock signals inputted into two clock signal terminals of each of the plurality of shift registers are inputted by forming a pair as 2 phase clock signals among the plurality of clock signals and thereafter, are sequentially inputted by exchanging each other.

A first control signal is inputted into a first control signal terminal ESR and a second control signal is inputted into a second control signal terminal ESS between two control signal terminals ESR and ESS.

The first control signal and the second control signal are used when being converted in the simultaneous driving mode or the sequential driving mode and may control an output voltage level of a scan signal outputted from each shift register in the simultaneous driving mode.

Referring to the circuit diagram according to the exemplary embodiment of FIG. 2, the shift register of the n-th stage among the plurality of shift registers constituting the scan driver includes a transistor M1 transferring a voltage corresponding to the initial signal, or the output signal of the previous stage, to a first node N1, when it is turned on in response to a first clock signal inputted into a clock signal terminal CLK. A transistor M4 transferring a first power supply voltage VGH as an output signal, when it is turned on in response to the first clock signal inputted into the clock signal terminal CLK. A transistor M5, turned on by a voltage transferred to the first node N1, to transfer a voltage of a second clock signal, applied to a clock signal terminal CLKB, as the output signal. A transistor M8, turned on by a first control signal inputted into a first control signal terminal ESR, to transfer the first power supply voltage VGH as the output signal. A transistor M9, turned on by a second control signal inputted into a second control signal terminal ESS, to transfer a second power supply voltage VGL, having a voltage value lower than the first power supply voltage, to a second node N2. And a transistor M10 transferring the second power supply voltage VGL as the output signal, when it is turned on by receiving the second power supply voltage VGL transferred to node N2.

In detail, the transistor M1 includes a gate terminal connected to the clock signal terminal CLK to which the first clock signal is transferred, a source terminal connected to input signal terminal FLM(n) into which an initial signal or an output signal of a previous stage is inputted, and a drain terminal connected to the first node N1.

The transistor M4 includes a gate terminal connected to the clock signal terminal CLK to which the first clock signal is transferred, a source terminal connected to a power supply terminal to which the first power supply voltage VGH is supplied, and a drain terminal connected to the output signal terminal OUT(n) from which the output signal is generated and outputted.

The transistor M5 includes a gate terminal connected to the first node N1, a source terminal connected to the clock signal terminal CLKB to which the second clock signal is transferred, and a drain terminal connected to the output signal terminal OUT(n) from which the output signal is generated and outputted.

The output signal of the corresponding stage is outputted as a predetermined output voltage through the drain terminal of each of the transistors M4 and M5 by the sequential driving mode.

A capacitor C1 having one electrode and another electrode connected between the gate terminal and the drain terminal of the transistor M5, respectively, is included. The capacitor C1 may temporarily store a voltage, corresponding to the initial signal or the output signal of the previous stage, transferred to the first node N1.

The transistor M8 includes a gate terminal connected to the first control signal terminal ESR to which the first control signal is transferred, a source terminal connected to the power supply terminal to which the first power supply voltage VGH is supplied, and a drain terminal connected to the output signal terminal OUT(n) from which the output signal is generated and outputted.

The transistor M10 includes a gate terminal connected to a drain terminal of the transistor M9, a source terminal connected to the power supply terminal to which the second power supply voltage VGL, having the voltage value lower than the first power supply voltage VGH, is supplied, and a drain terminal connected to the output signal terminal OUT (n) to which the output signal is generated and outputted.

The transistor M9 that controls a switching operation of the transistor M10 includes a gate terminal connected to the second control signal terminal ESS to which the second control signal is transferred, a source terminal connected to the power supply terminal to which the second power supply voltage VGL is supplied, and a drain terminal connected to node N2 and the gate terminal of the transistor M10.

The output signal of the corresponding stage is outputted as a predetermined output voltage through the drain terminal of each of the transistors M8 and M10 by the simultaneous driving mode.

Further, in the exemplary embodiment of FIG. 2, the scan driver further includes a capacitor C2 having one electrode and another electrode connected between the gate terminal and the drain terminal of the transistor M10, respectively. The capacitor C2 may temporarily store the voltage transferred to the second node N2 connected with the gate terminal of the transistor M10.

The scan driver according to the exemplary embodiment of FIG. 2 may further include a transistor M6 transferring the first power supply voltage VGH to the second node N2.

The transistor M6 includes a gate terminal connected to the clock signal terminal CLK to which the first clock signal is transferred, a source terminal connected to the power supply terminal to which the first power supply voltage VGH is supplied, and a drain terminal connected to the second node N2. When the first power supply voltage VGH is transferred to the second node N2 by a switching operation of the transistor M6, the transistor M10 is stably turned off and the voltage of the drain electrode of the transistor M10 increases to a high level to float an output terminal. Therefore, the scan driver may be stably switched to the sequential driving mode from the state to output the scan signal through actuating the transistors M8 and M10 by being driven in the simultaneous driving mode.

In the exemplary embodiment of FIG. 2, the control signal transferred to the gate terminal of the transistor M6 includes, for example, the first clock signal, but is not limited thereto and the control signal may the second clock signal or may be variously configured by predetermined other control signals.

The transistor M6 included in each of the plurality of shift registers of the scan driver is switched on to simultaneously turn off the transistor M10 generating the output signal according to the simultaneous driving mode and floats a voltage at an output stage to a high state to set a state for performing the sequential driving mode.

In some cases, the shift register of the scan driver according to the exemplary embodiment of FIG. 2 may further include at least one transistor M7 between the first control signal terminal ESR and the transistor M8.

A gate terminal of the transistor M7 is connected to the first control signal terminal ESR, a source terminal is connected to the power supply terminal supplying the first power supply voltage VGH, and a drain terminal is connected to the second node N2.

Accordingly, each of the transistor M7 and the transistor M8 is turned on according to the first control signal transferred to the first control signal terminal ESR to turn off the transistor M10 and outputs the first power supply voltage VGH having a high level through the transistor M8 as the output signal.

Meanwhile, in the exemplary embodiment of FIG. 2, the shift register further includes a transistor M2 and a transistor M3 connected between the power supply terminal supplying the first power supply voltage VGH and the first node N1.

That is, at least one of the transistor M2 and the transistor M3 may be formed such that a source terminal of each transistor is connected to a supply terminal of the first power supply voltage VGH and a drain terminal of each transistor is connected to the first node N1.

However, a gate terminal of the transistor M2 is connected to the first control signal terminal ESR to which the first control signal is transferred, and a gate terminal of the transistor M3 is connected to the second control signal terminal ESS to which the second control signal is transferred.

Therefore, when the scan driver is actuated by the simultaneous driving mode, the first control signal or the second control signal is transferred to the gate terminal of the transistor M2 or the gate terminal of the transistor M3 as a voltage having a gate-on level to transfer the first power supply voltage VGH having the high level to the first node N1 and turn off the transistor M5. As a result, in the simultaneous driving mode, the output signal is controlled and outputted by actuating the transistor M8 and the transistor M10 adjacent to the output stage.

Figure 3:
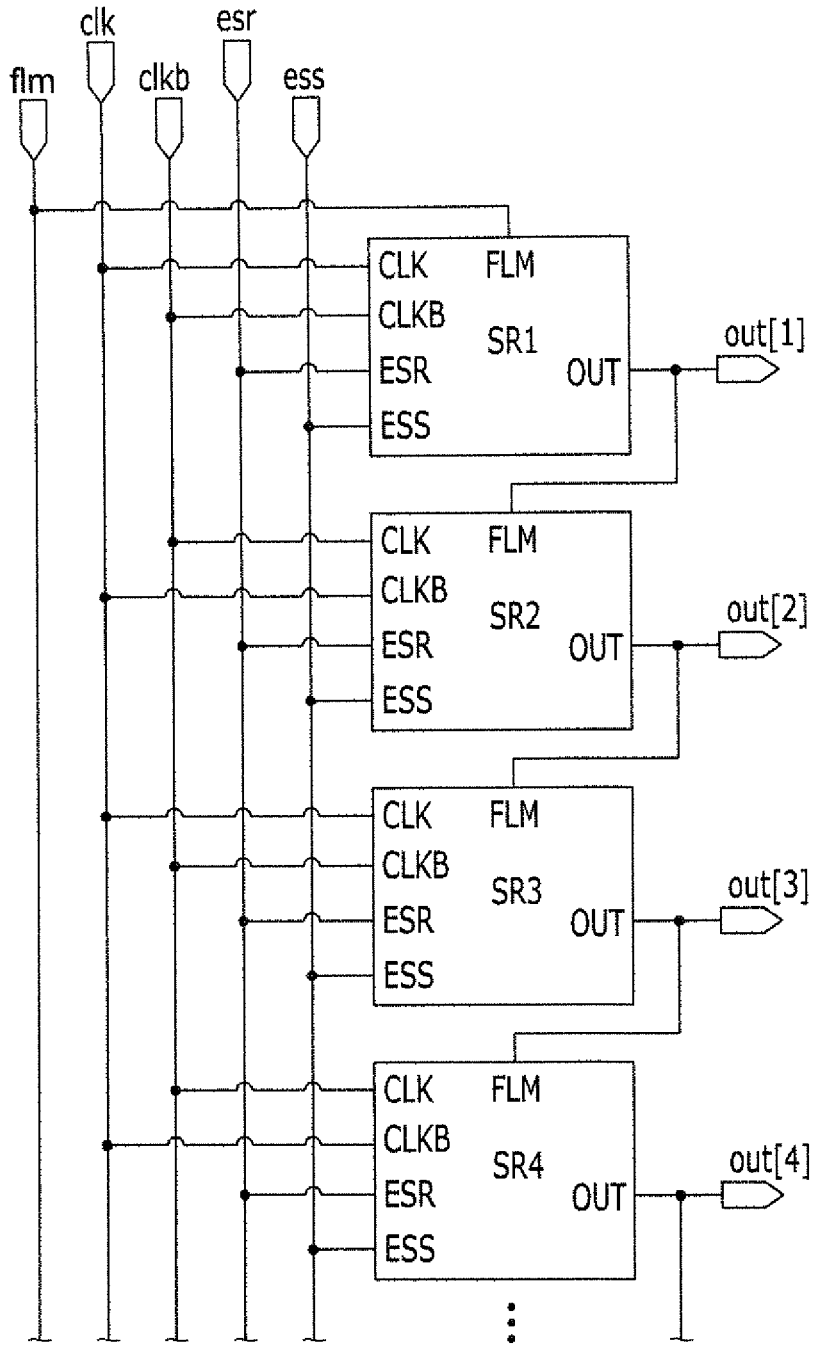
FIG. 3 is a block diagram illustrating a driving state of the circuit diagram shown in FIG. 2.
Figure 4:
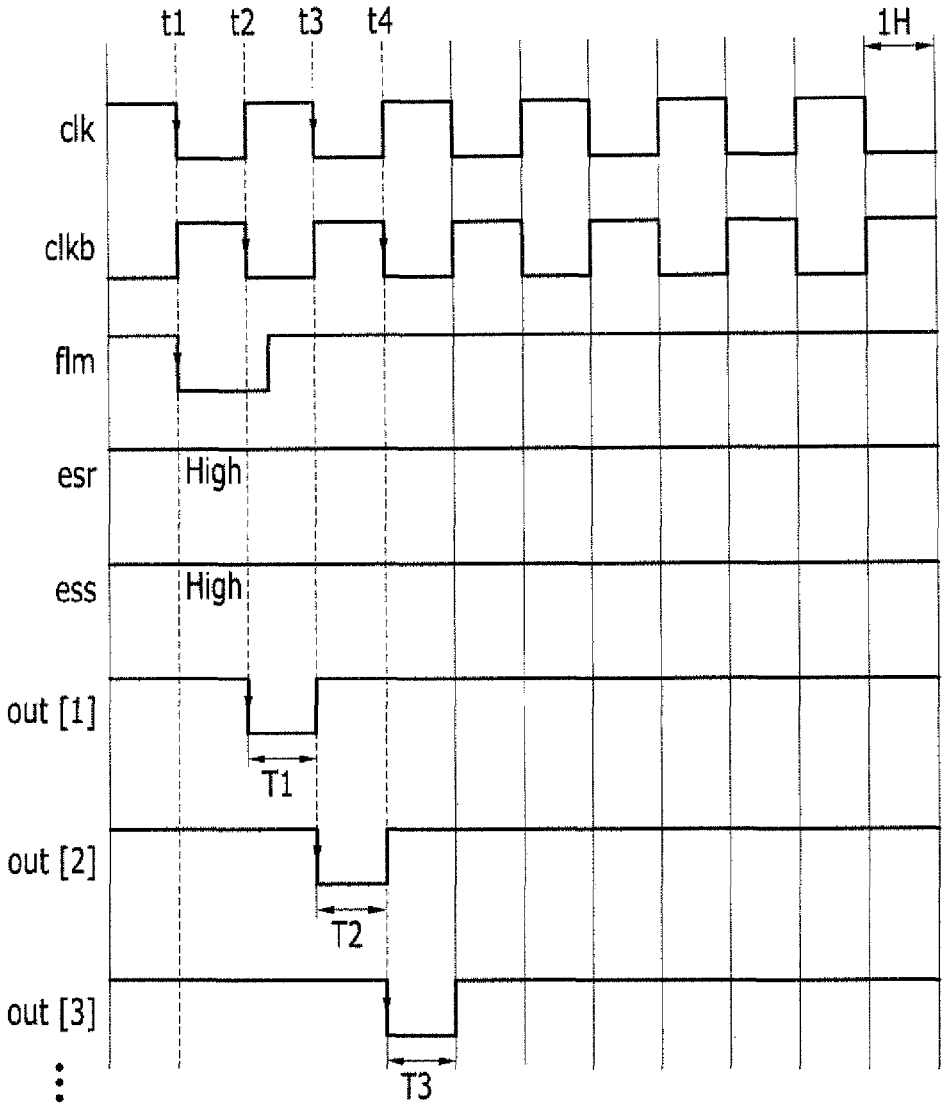
FIG. 4 is a driving timing diagram of the scan driver according to the block diagram shown in FIG. 3.

FIG. 3 is a block diagram illustrating a driving state of the circuit diagram shown in FIG. 2, and FIG. 4 is a driving timing diagram of the scan driver according to the block diagram shown in FIG. 3.

FIG. 4 is a timing diagram of the sequential driving mode and the simultaneous driving mode will be described below in FIG. 9.

Referring to the scan driver shown in FIG. 3 and FIG. 4 showing the driving timing diagram by the sequential driving mode, a duty rate of the output signal outputted to the output stage is a 1 horizontal cycle (1H) and two clock signals are transferred to the 2 phase clock signal terminals CLK and CLKB.

That is, the number of clock signals transferred to an input terminal of a 2 phase clock signal is determined depending on the duty rate of the output signal of the scan driver. When the duty rate of the output signal of the scan driver is outputted at an n-times horizontal cycle (n×H), the number of the clock signals is 2n.

Therefore, in FIGS. 3 and 4, since the duty rate of output signals out to out outputted through the output stages of the shift registers is 1H, the number of the clock signals inputted into the 2 phase clock signal terminal is 2 (=2×1).

Referring to FIG. 3, a first clock signal clk and a second clock signal clkb are alternately inputted into the first clock signal terminal CLK and the second clock signal terminal CLKB of each shift register, respectively. That is, when the first clock signal clk and the second clock signal clkb are transferred to the first clock signal terminal CLK and the second clock signal terminal CLKB of a shift register SR1 of a first stage, respectively, the sequence of the 2 phase clock signals is reversed, such that the second clock signal clkb and the first clock signal clk are transferred to the first clock signal terminal CLK and the second clock signal terminal CLKB of a shift register SR2 of a second stage which is the subsequent stage, respectively.

Meanwhile, the initial signal flm or the output signal of the shift register of a just previous stage (out[n]) is transferred to the input signal terminal FLM of each shift register.

That is, the initial signal flm is inputted into the input signal terminal FLM of the shift register of the first stage, but the output signal of each stage is transferred to the shift registers of the subsequent stages, respectively, as shown. When the duty rates of the output signals of the scan driver are outputted at an n-times horizontal cycle (n×H), the initial signal is transferred to input signal terminals of shift registers of n first stages. Therefore, when the output signals are outputted at the horizontal cycle of 1H, the initial signal is transferred to only the input signal terminal of a shift register of one first stage as described in the exemplary embodiment of FIGS. 3 and 4.

Further, a first control signal esr and a second control signal ess are inputted into the first control signal terminal ESR and the second control signal terminal ESS, respectively.

Each shift register generates an output signal and outputs it at the output terminal thereof by signals inputted into five input terminals.

A detailed circuit structure of the shift register is described in FIG. 2 and a generation process of the output signal will be described with reference to the circuit structure of FIG. 2 and FIG. 3 and the timing diagram of FIG. 4.

The transistors shown in the circuit diagram of FIG. 2 are PMOS transistors as an example. Therefore, a signal waveform of FIG. 4 operates on the basis of a low-level pulse as a gate turn-on voltage. However, it is merely one exemplary embodiment and the present invention is not limited thereto.

In FIG. 4, the first clock signal clk and the second clock signal clkb inputted into the scan driver of the present invention have a low level pulse repeated at a cycle of 2H. In FIG. 4, the first clock signal clk and the second clock signal clkb have a phase difference from each other by a half cycle (1H).

First, at a time t1, when the first clock signal clk and the initial signal flm are synchronized with each other and transferred to the clock signal terminal CLK and the input signal terminal FLM of the first shift register SR1 at a low level, the transistor M1 and the transistor M4 are turned on. In this case, the low-level voltage of the initial signal flm is transferred to the first node N1 through the transistor M1 and at the same time, the first power supply voltage VGH is outputted to the output stage.

Therefore, at the time t1, the voltage level of the output signal out of the first shift register SR1 is high.

In this case, the low-level voltage transferred to the first node N1 is stored in the first capacitor C1.

In this case, even though the first clock signal clk and the initial signal flm shift to a high state at a time t2, the low-level voltage transferred to the first node N1 turns on the transistor M5 to generate the output signal out by the second clock signal clkb inputted as the low-level voltage at the time t2. Accordingly, the output signal out of the first shift register SR1 having the low-level pulse, i.e., a scan signal transferred to a first pixel row, is generated during the times t2 and t3, i.e., a period T1 (1H).

The duty rate of the scan signal of the shift register of the scan driver according to FIGS. 3 and 4 is a 1 horizontal cycle and the output signal of the shift register SR1 is transferred to the input signal terminal FLM of the shift register SR2 of the just subsequent stage.

Therefore, the output signal out[1] of the first shift register SR1 is outputted from the output terminal at the time t2 and at the same time, transferred to the input signal terminal FLM of the second shift register SR2. In this case, as shown in FIG. 3, the second clock signal clkb is transferred to the first clock signal terminal CLK of the second shift register SR2.

Since both the output signal out[1] of the first shift register SR1 transferred to the input signal terminal FLM of the second shift register SR2 and the second clock signal clkb transferred to the first clock signal terminal CLK of the second shift register SR2 are at the low-voltage level at the time t2, the transistor M4 of the second shift register SR2 is turned on and the low voltage is transferred to the first node N1 and stored in the first capacitor C1 of the second shift register SR2.

Since the first power supply voltage VGH which is the high-level voltage is transferred to an output signal out[2] of the second shift register SR2 by turning on the transistor M4, the output signal out of the second shift register SR2 is in a high state at the time t2.

When the output signal out[1] of the first shift register SR1 and the second clock signal clkb shift to the high state at the time t3, the transistor M4 of the second shift register SR2 is turned off and the transistor M5 of the second shift register SR2 is turned on by the low-level voltage stored in the first capacitor C1.

In FIG. 3, a clock signal transferred through the second clock signal terminal CLKB by turning on the transistor M5 of the second shift register SR2 is the first clock signal clk.

Since the first clock signal clk is transferred as the low-level pulse at the time t3, the output signal out[2] outputted from the second shift register SR2 is in the low-voltage level.

That is, during a period of the time t3 and a time t4, i.e., T2, the output signal out[2] of the second shift register SR2 is outputted in a low state.

Both the first control signal esr and the second control signal ess maintain a high-level voltage state while the output signal is generated in the sequential driving mode.

Accordingly, the transistors M2, M3, M7, M8, and M9 to which the first control signal esr and the second control signal ess are transferred are all turned off, such that a voltage pulse of the output signal is controlled depending on switching operations of the transistors M4 and M5.

The plurality of shift registers included in the scan driver sequentially generate the output signals having the duty rate of a 1 horizontal cycle by repetitively performing the above-mentioned process. Herein, since the output signals have the duty rate of a 1 horizontal cycle, the output signals generated by the scan driver according to the exemplary embodiment FIGS. 3 and 4 are not overlapped.

The duty rate should be equal to or more than at least twice the horizontal cycle in order to overlap the output signals sequentially outputted from the shift registers of the scan driver.

A block diagram and a driving timing diagram of the scan driver that sequentially generates the overlapped output signals are shown in FIGS. 5 to 8.

The circuit diagram of the shift registers of the stages constituting the scan driver according to the exemplary embodiment associated with FIGS. 5 to 8 is the same as that of FIG. 2. However, the scan driver is designed with a driving time different from the signals inputted into the components constituting the circuit of FIG. 2.

Figure 5:
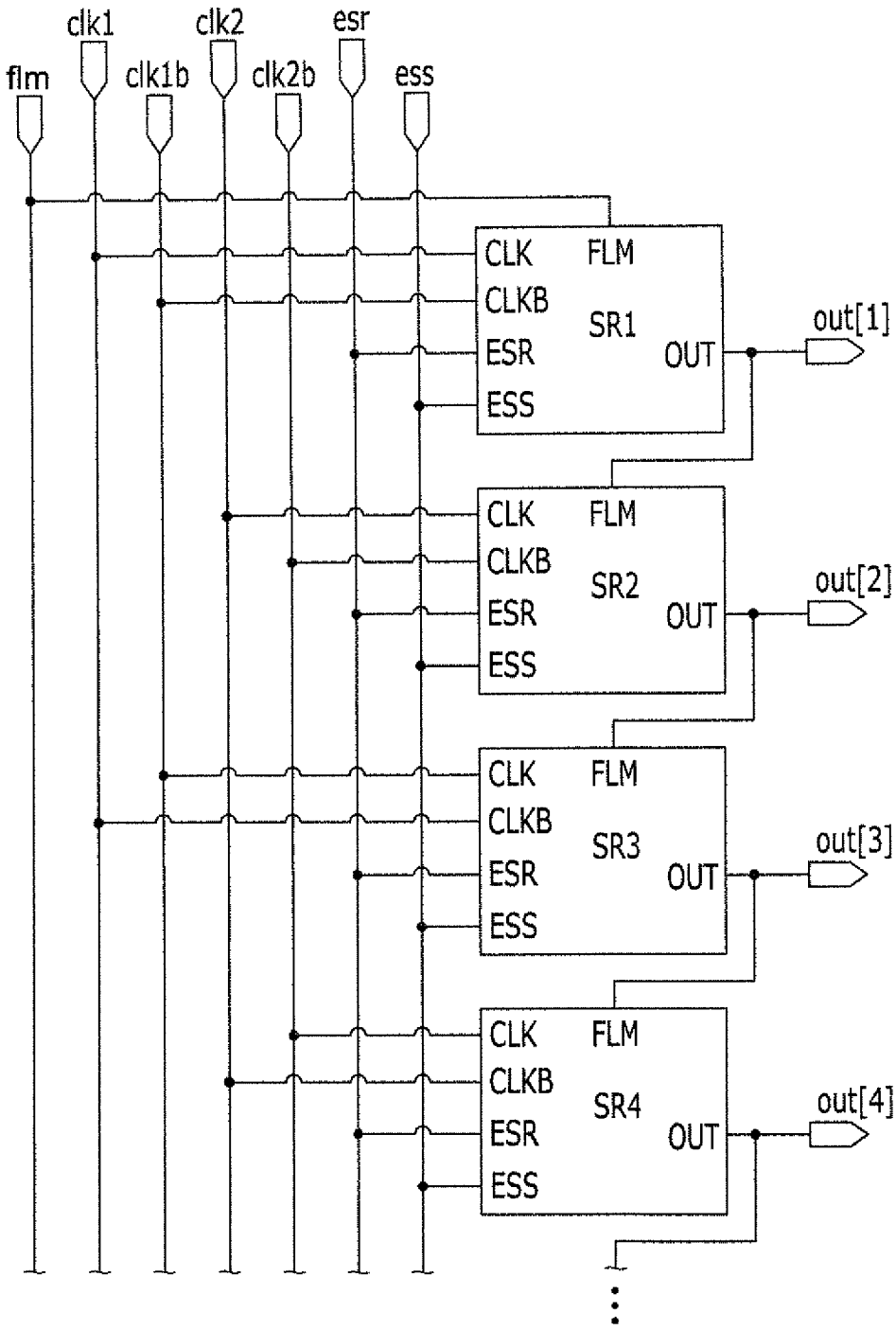
FIG. 5 is a block diagram illustrating a driving state according to another embodiment of the circuit diagram shown in FIG. 2.
Figure 6:
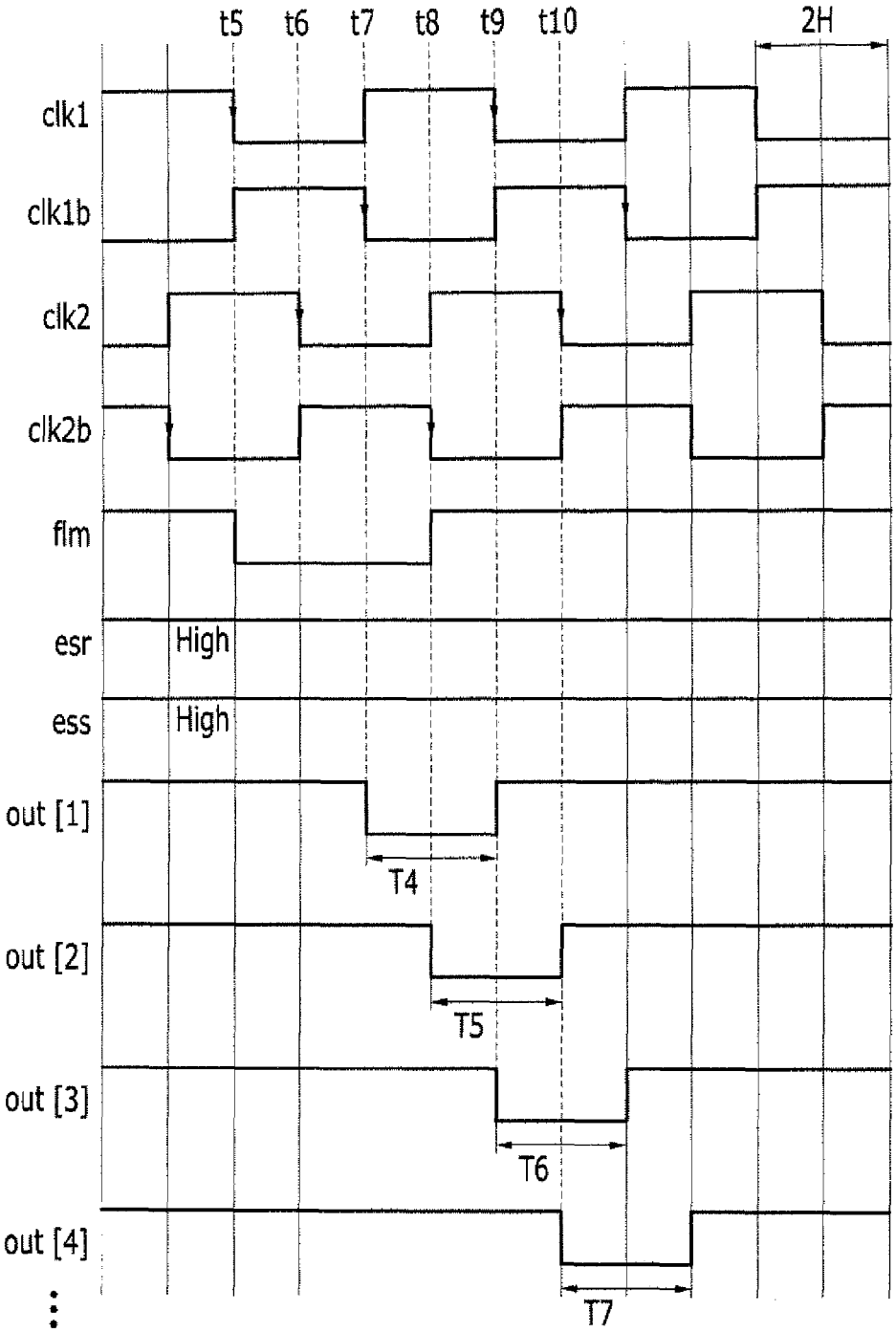
FIG. 6 is a driving timing diagram of the scan driver according to the block diagram shown in FIG. 5.

First, in the case of the scan driver shown in FIGS. 5 and 6, the duty rate of a scan signal is a twice horizontal cycle and the scan signals are outputted while being overlapped by a 1 horizontal cycle.

The block diagram of FIG. 5 is not largely different from that of FIG. 3, but they are different from each other in that the number of clocks inputted into the first clock signal terminal and the second clock signal terminal is 4 (2×2). Since 2 phase clock signals are transferred to the clock signal terminal, the number of the clocks is twice more than the duty rate of the output signal as described in the above equation.

Referring to FIG. 5, the initial signal flm is inputted into the input signal terminal FLM of the shift register SR1 of the first stage and the output signal out[1] is inputted into the input signal terminal FLM of the shift register SR2 of the subsequent stage. However, it is one exemplary embodiment, and in another exemplary embodiment the initial signal is inputted into the input signal terminals FLM of the shift registers of first two stages and thereafter, the output signal of the corresponding stage may be inputted into the input signal terminal FLM of the shift register of the subsequent second stage. In the exemplary embodiments, the number of stages into which the initial signal is inputted and the number of the subsequent stages to which the output signal of the corresponding stage is transferred is n (n is a natural number) when the duty rate of the output signal is n×H.

Two 2 phase clock signals are alternately inputted into the first clock signal terminal CLK and the second clock signal terminal CLKB of each shift register of the scan driver according to FIG. 5, in sequence. That is, the 2 phase clock signals among four clock signals are sequentially inputted while forming a pair with each other and thereafter, inversely inputted while an input sequence is reversed.

A first clock signal clk1 and a first clock bar signal clk1*b* are inputted into the first clock signal terminal CLK and the second clock signal terminal CLKB of the first shift register SR1, respectively, and a second clock signal clk2 and a second clock bar signal clk2*b* are inputted into the first clock signal terminal CLK and the second clock signal terminal CLKB of the second shift register SR2, respectively. Thereafter, the inputted clock signals are reversed in their order and transferred to the first clock signal terminal CLK and the second clock signal terminal CLKB of each of a third shift register SR3 and a fourth shift register SR4. The first clock bar signal clk1*b* and the first clock signal clk1 are inputted into the first clock signal terminal CLK and the second clock signal terminal CLKB of the third shift register SR3, respectively, and the second clock bar signal clk2*b* and the second clock signal clk2 are inputted into the first clock signal terminal CLK and the second clock signal terminal CLKB of the fourth shift register SR4, respectively.

According to such a method, the clock signals are alternately transferred to shift registers of the subsequent stages in sequence.

A process of generating output signals having a cycle of 2H through driving by the input signal or clock shown in FIG. 5 is shown in FIG. 6.

The timing diagram of FIG. 6 is not largely different from that of FIG. 4, but a period in which the initial signal flm sustains the low-voltage level becomes a period of a time t5 to a time t8 including a period in which the first clock signal clk1 and the second clock signal clk2 have a low level.

When both the first clock signal clk1 and the initial signal flm are transferred at a low level at the time t5, the transistor M4 of shift register SR1 is turned on to transfer the first power supply voltage VGH having a high level to the output signal out[1] of the first stage. The output signal out[1] of the first stage outputted as the high-voltage level of the first power supply voltage VGH during the twice horizontal cycle (2×H) is outputted while a low-voltage level of the first clock bar signal clk1*b* transferred by the transistor M5 of shift register SR1 which is switched on by the low voltage stored in the first capacitor C1 at the time t7. The output signal out[1] is outputted in a low state during a period in which the first clock bar signal clk1*b* is sustained at the low-voltage level, T4. In this case, the transistor M4 is switched off by the first clock signal clk1 which shifts to the high state.

Meanwhile, during a period of times t6 to t8 in which the second clock signal clk2 inputted into the first clock signal terminal CLK is transferred in the low state, the output signal out[1] outputted from the first stage is transferred in the low state as an input signal of a second stage at the time t7.

In this case, by the same process as the first stage, an output signal out of the second stage is synchronized with the time t8 in which the second clock bar signal clk2*b* inputted into the second clock signal terminal CLKB of shift register SR2 is transferred in the low level to be outputted as output signal out[2], which is a low pulse during the period T5.

The output signal out[2] outputted from the shift register SR2 of the second stage is transferred to a shift register SR3 of a third stage as an input signal and the first clock bar signal clk1*b* is transferred to the first clock signal terminal CLK of shift register SR3. Accordingly, the shift register SR3 of the third stage is driven by the low-level voltage of the output signal out[2] of the second stage and the first clock bar signal clk1*b* transferred at the time t8 and generates the output signal out[3] through the above-mentioned process.

In this case, an output signal out[3] of a third stage is synchronized with a time t9 in which the first clock signal clk1 of the second clock signal terminal CLKB transferred by turning on the transistor M5 of shift register SR3 is transferred in the low level to be outputted as a low pulse during the period T6.

According to such a method, the first control signal esr and the second control signal ess maintain a high state of voltage at all times while the output signals having the duty rate of 2H are sequentially generated.

The output signals outputted according to the method of FIG. 6 are outputted by being overlapped by a 1 horizontal cycle.

Figure 7:
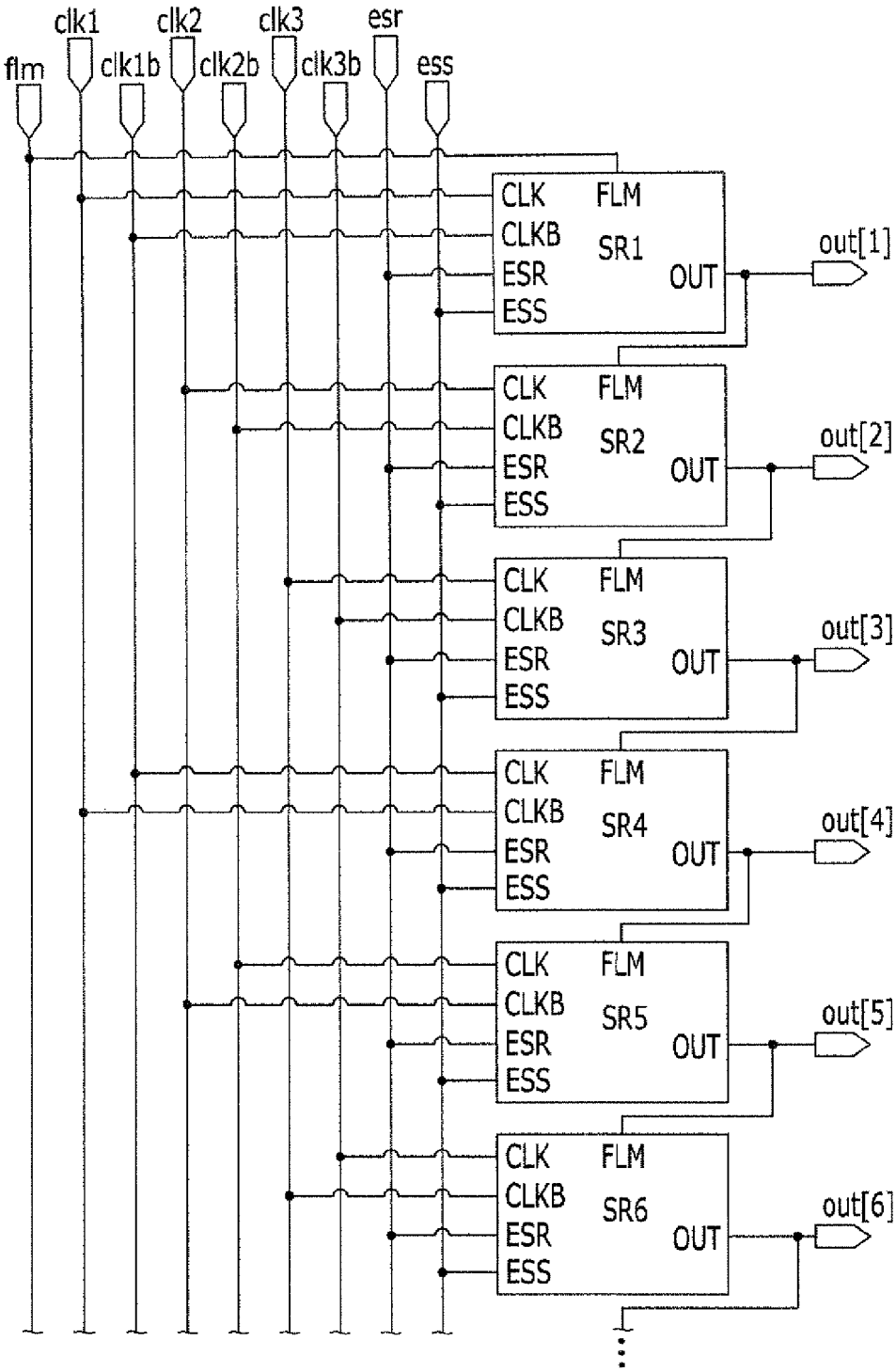
FIG. 7 is a block diagram illustrating a driving state according to yet another embodiment of the circuit diagram shown in FIG. 2.
Figure 8:
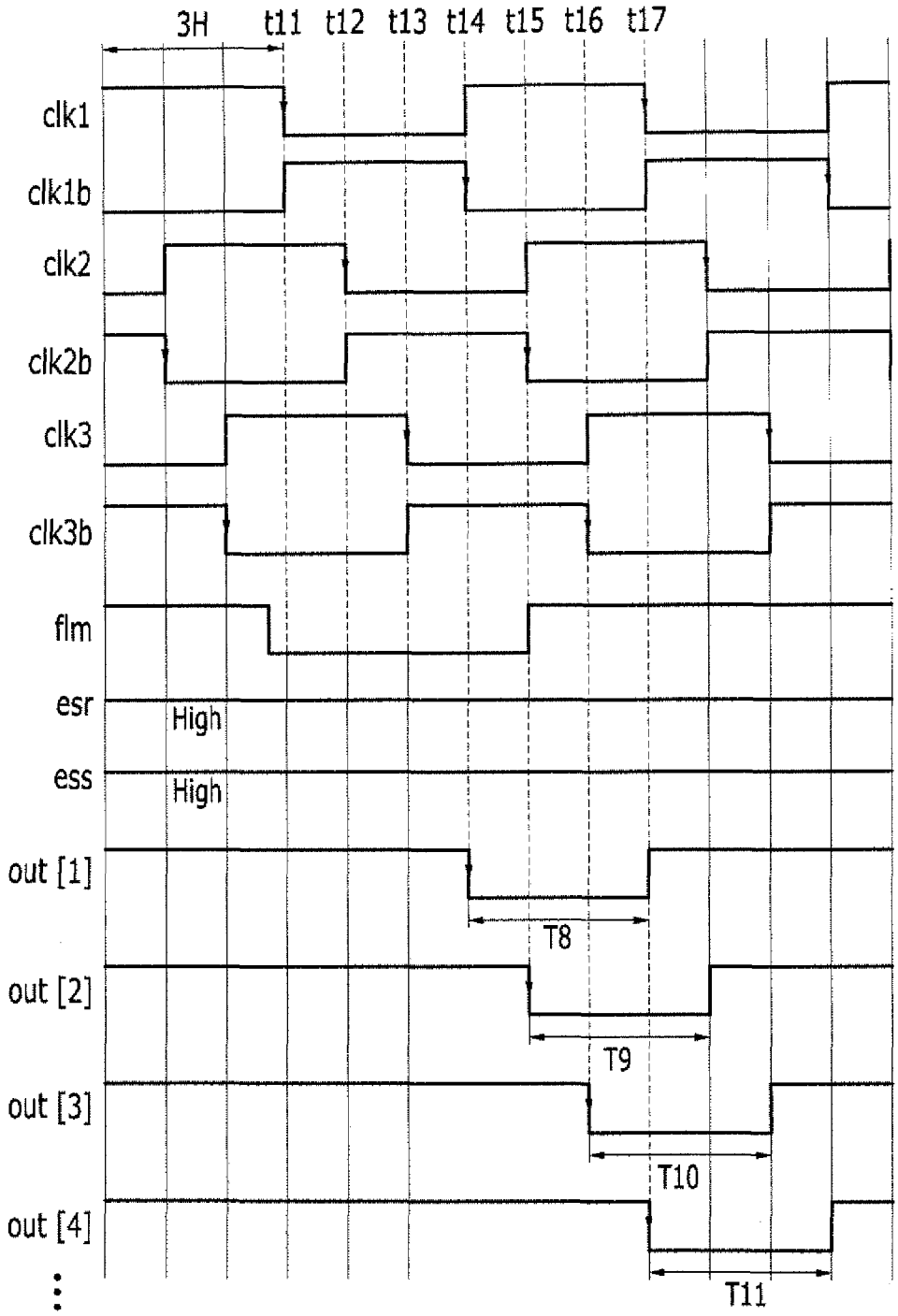
FIG. 8 is a driving timing diagram of the scan driver according to the block diagram shown in FIG. 7.

FIGS. 7 and 8 are a block diagram of a scan driver for sequentially driving and generating output signals outputted at a duty rate of a triple horizontal cycle and a driving timing diagram thereof.

Since a description of FIGS. 7 and 8 is not largely different from the description of FIGS. 5 and 6 in which the output signal having the duty rate of twice horizontal cycle is generated, a description of duplicated parts will be omitted and a difference therebetween will be primarily described.

The number of clock signals inputted into the scan driver for generating the output signals outputted at the duty rate of triple horizontal cycle is 6 (=2×3) and the clock signals are transferred as 2 phase clock signals in which two clock signals form a pair.

There is a phase difference of a half cycle between the 2 phase clock signals, which are transferred as pulses which are not overlapped with each other.

Further, the initial signal flm is transferred to the shift register SR1 of the first stage and thereafter, the output signal of each corresponding stage is transferred as the input signal of the shift register (SR2~SRn) of each just subsequent stage. However, it is merely one exemplary embodiment and in other exemplary embodiments, the initial signal is transferred to shift registers of first three stages and thereafter, an output signal outputted from a shift register of a previous stage, i.e., a 3rd previous stage among stages prior to the corresponding stage, may be received as the input signal from a shift register of a fourth stage.

Referring to FIG. 7, two 2 phase clock signals are alternately inputted into the first clock signal terminal CLK and the second clock signal terminal CLKB of each shift register in sequence. That is, the 2 phase clock signals among six clock signals are sequentially inputted while forming a pair with each other and thereafter, inversely inputted while an input sequence is reversed.

Further, the initial signal flm inputted into the shift register SR1 of first stage is transferred in the low level during a period from a time t11 to a time t15 in the exemplary embodiment of FIG. 7. The period includes at least a period in which the first clock signal clk1 transferred to the first clock signal terminal CLK of the shift register SR1 of the first stage is transferred in the low level.

The process in which the signal is inputted and driven and the scan signal is generated as shown in FIGS. 7 and 8 is the same as that of FIGS. 5 and 6. Like the exemplary embodiment, the first control signal esr and the second control signal ess sustain a high state of voltage at all times while being sequentially driven.

The output signal out of the first stage having the duty rate of 3H is synchronized with the low-level pulse of the first clock bar signal clk1*b* transferred by turning on the transistor M5 of shift register SR1 to shift to the low level at the time t14 and outputted as the pulse (out[1]) having the low-voltage level during the period of 3H in which the low-level pulse of the first clock bar signal clk1*b* is sustained, i.e., the period T8. Subsequently, output signals after the first stage are sequentially outputted by a phase difference of 1H. The output signals are sequentially outputted while being overlapped with each other by 2H.

Figure 9:
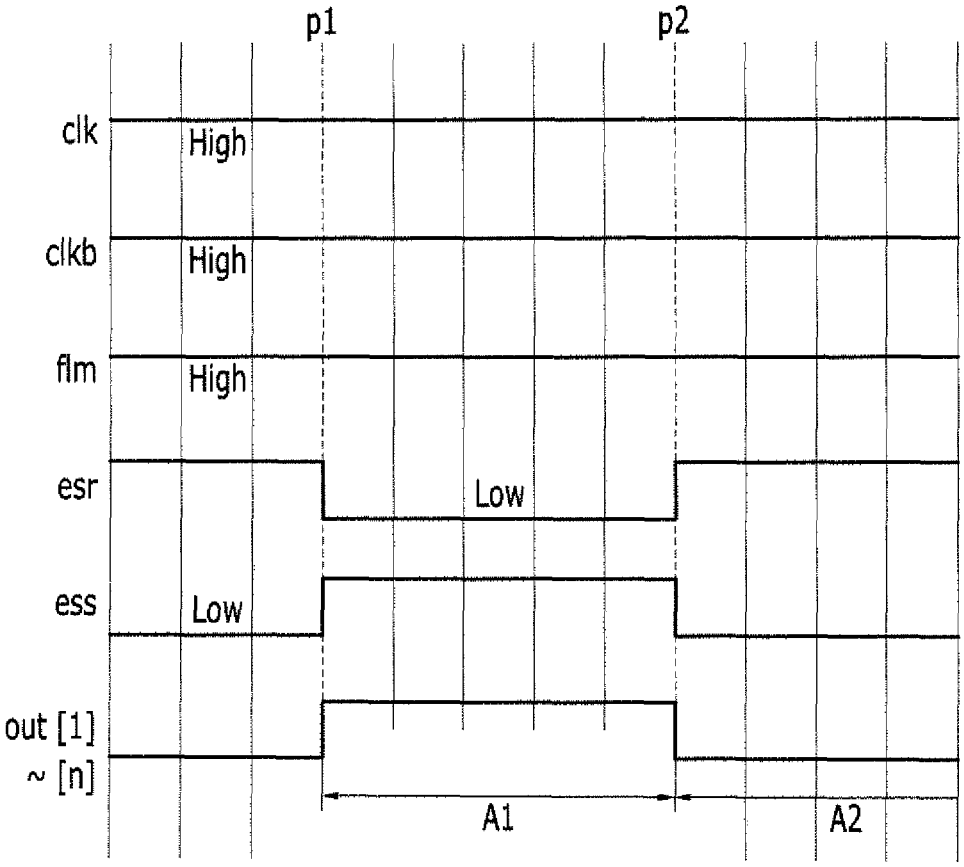
FIG. 9 is a timing diagram in which the scan driver shown in FIG. 2 is driven according to a simultaneous driving mode of a display device.

FIG. 9 illustrates a signal timing diagram not in a sequential driving mode but in a simultaneous driving mode of the scan driver.

The scan driver of the present invention is designed so that the shift registers are applied to both the simultaneous driving mode and the sequential driving mode to output the output signals.

FIG. 9 describes the simultaneous driving mode of the scan driver in which two 2 phase clock signals are driven, but is not necessarily limited thereto and the simultaneous driving mode may be equally applied to even a scan driver in which a plurality of clock signals are used.

Referring to FIG. 9, the initial signal flm, the first clock signal clk, and the second clock signal clkb that are inputted while the output signals out[1]~[n] are generated in the simultaneous driving mode are all transferred as the high-level voltage.

Accordingly, all transistors of which gate terminals receive the above mentioned high-level voltage signals are turned off. Even in the case where the plurality of clock signals are transferred, all clock signals are transferred as the high-level pulse to turn off the transistor.

Therefore, referring to the circuit diagram of FIG. 2, the switching operations of the transistors M1, M4, and M6 in which the initial signal flm, the first clock signal clk, and the second clock signal clkb are transferred directly to the gate terminals thereof are turned off.

In the simultaneous driving mode, the first control signal esr and the second control signal ess transferred to the scan driver are not overlapped with each other and inputted while the voltages levels of the signals shift at the same time.

The scan driver of the present invention may output the output signals outputted from the shift registers of all the stages as a voltage of a gate-on level or as a voltage of a gate-off level at once by adjusting the voltage levels of the first control signal esr and the second control signal ess.

In detail, the first control signal esr is transferred as the low-level pulse at a time p1 and in this case, the second control signal ess is transferred as the high-level pulse which is reverse thereto. Therefore, switching operations of all the transistors M2, M7, and M8 of which the shift registers receive the first control signal esr which is the low-level pulse at the gate terminals thereof are turned on. Meanwhile, switching operations of the transistors M3 and M9 of which the shift registers receive the second control signal ess which is the high-level pulse at the gate terminals thereof are turned off.

In this case, the first power supply voltage VGH which is the high-level voltage is transferred to the first node N1 through the transistor M2 which is turned on and the transistor M5 of which the gate terminal is connected to the first node N1 is completely turned off. Since the first clock signal clk is already transferred as the high voltage to turn off the transistor M4, the voltage of the output signal is not controlled through the transistors M4 and M5.

Meanwhile, each of the transistors M7 and M8 which are turned on transfers the first power supply voltage VGH having the high level from a power supply terminal connected to a source terminal thereof to the second node N2 and the output stage.

The transistor M10 of which the gate terminal is connected to the second node N2 is turned off by the first power supply voltage VGH having the high level. In addition, the voltage of the first power supply voltage VGH having the high level is transferred as the output signal through the transistor M8. As shown in FIG. 9, the output signals out[1] to out[n] outputted from all stages are outputted as high-level pulses during a period A1 by the first control signal esr transferred during the period A1 as the low-level voltage.

Meanwhile, when the first control signal esr shifts to the high state and the second control signal ess shifts to the low state at a time p2, all the transistors M2, M7, and M8 that receive the first control signal esr are switched off and the transistors M3 and M9 that receive the second control signal ess are switched on.

When the transistor M3 is turned on, the transistor M3 transfers the first power supply voltage VGH which is the high-level voltage like the transistor M2 to the first node N1 and completely turns off the transistor M5 connected thereto.

When the transistor M9 is turned on, the transistor M9 transfers the second power supply voltage VGL which is the low-level voltage to the second node N2. The second power supply voltage VGL may be temporarily stored by the second capacitor C2 connected to the second node N2 during a predetermined period.

The second power supply voltage VGL having the low level applied to the second node N2 is transferred to the gate terminal of the transistor M10, which is turned on. In this case, the second power supply voltage VGL connected to the source electrode of the transistor M10 is transferred as the output signal of the output stage through the transistor M10. Since the second power supply voltage VGL is the low-level voltage, the voltage of the output signal transferred through the drain terminal of the transistor M10 is in the low level. In detail, the output signal is generated and transferred as the low-level pulse slightly increased from the low voltage value of the second power supply voltage VGL by a threshold voltage value of the transistor M10. The output signals out to out outputted from all the stages are outputted as the low-level pulses during a period A2 by the second control signal ess transferred during the period A2 from the time p2.

As such, according to the exemplary embodiment of FIG. 9, by controlling the input of the low-level pulse of the first control signal esr or the second control signal ess, the scan signals outputted from all the stages of the scan driver may be outputted in the high state or low state at once.

Accordingly, in the display device driven in the simultaneous light emitting mode, the scan signals transferred to all pixel rows of the display panel can be outputted in the high state or low state at once during a reset period, a threshold voltage compensation period, and a light emitting period and the scan signals transferred for the pixel rows of the display panel can be sequentially generated and transferred during a data writing period.

While this invention has been described in connection with what is presently considered to be practical exemplary embodiments, it is to be understood that the invention is not limited to the disclosed embodiments. But, on the contrary, this invention is intended to cover various modifications and equivalent arrangements included within the spirit and scope of the appended claims. Further, the materials of the components described in the specification may be selectively substituted by various known materials by those skilled in the art. In addition, some of the components described in the specification may be omitted without the deterioration of the performance or added in order to improve the performance by those skilled in the art. Moreover, the sequence of the steps of the method described in the specification may be changed depending on a process environment or equipments by those skilled in the art. Accordingly, the scope of the present invention should be determined by not the above-mentioned exemplary embodiments but the appended claims and the equivalents thereto.

What is claimed is:

1. A scan driver, comprising:

a plurality of shift registers including an input signal terminal into which an initial signal or a scan signal of a previous stage is inputted, two clock signal terminals to which 2 phase clock signals are transferred, two control signal terminals to which a first control signal and a second control signal controlling a driving mode of simultaneously driving or sequentially driving output signals of all stages are transferred, and scan signals terminals from which the scan signals are outputted, wherein in the sequential driving mode, the first control signal and the second control signal are transferred as a predetermined first level voltage, in the simultaneous driving mode, the first control signal and the second control signal are transferred only alternately as the predetermined first level voltage and a predetermined second level voltage, and a corresponding row is selected from a plurality of pixel rows by a driving scan signal among the driving scan signals and data signals are transferred in the selected corresponding row.

2. The scan driver of claim 1, the predetermined first level voltage is in a gate off voltage level and the predetermined second level voltage is in a gate on voltage level.

3. The scan driver of claim 1, the first control signal and the second control signal are not overlapped with each other in the simultaneous driving mode.

4. The scan driver of claim 1, signals transferred to the input signal terminal and the clock signal terminal are voltages having the gate off level in the simultaneous driving mode.

5. The scan driver of claim 1, when duty rates of the scan signals are outputted with an n-time horizontal cycle (n×H), the number of the clock signals is 2n where n being a natural number.

6. The scan driver of claim 5, the scan signals are overlapped with each other by an (n−1)-time horizontal cycle ((n−1)×H).

7. The scan driver of claim 1, two clock signals transferred to two clock signal terminals have a phase difference from each other by a half cycle.

8. The scan driver of claim 1, the first level voltage is a high-level voltage and the second level voltage is a low-level voltage.

9. The scan driver of claim 1, the shift register comprises, a first transistor transferring a voltage corresponding to the initial signal or the scan signal of the previous stage when being turned on in response to a first clock signal;

a second transistor transferring a first power supply voltage as the output signal of the sequential driving mode when being turned on in response to the first clock signal;

a third transistor transferring a voltage depending on a second clock signal as the scan signal of the sequential driving mode when being turned on by receiving the voltage corresponding to the initial signal or the output signal of the previous stage;

a fourth transistor transferring the first power supply voltage as the scan signal of the simultaneous driving mode when being turned on in response to the first control signal;

a fifth transistor transferring a second power supply voltage having a voltage value lower than the first power supply voltage when being turned on in response to the second control signal; and a sixth transistor transferring the second power supply voltage as the scan signal of the simultaneous driving mode when being turned on by receiving the second power supply voltage.

10. The scan driver of claim 9, the shift register further comprises, a first capacitor connected between a gate terminal and a drain terminal of the third transistor; and a second capacitor connected between a gate terminal and a drain terminal of the sixth transistor.

11. The scan driver of claim 9, the shift register further comprise sat least two transistors connected between a first power supply to which the first power supply voltage is applied and a first node connected to a drain terminal of the first transistor and the gate terminal of the third transistor.

12. The scan driver of claim 11, the two transistors are a seventh transistor transferring the first power supply voltage to the first node when being turned on in response to the first control signal; and an eighth transistor transferring the first power supply voltage to the first node when being turned on in response to the second control signal.

13. The scan driver of claim 9, the shift register further comprises at least one ninth transistor transferring the first power supply voltage to the gate terminal of the sixth transistor when being turned on in response to the first control signal.

14. The scan driver of claim 9, the shift register further comprises at least one tenth transistor transferring the first power supply voltage to the gate terminal of the sixth transistor when being turned on in response to any one signal of the first clock signal, the second clock signal, and a predetermined third control signal.

15. The scan driver of claim 9, the shift register generates the scan signal as a pulse of a voltage level depending on the first power supply voltage or the second clock signal in the sequential driving mode to sequentially generate and output the scan signals of all the stages.

16. The scan driver of claim 9, the shift register generates the scan signal as a pulse of a voltage level depending on the first power supply voltage or the second power supply voltage in the simultaneous driving mode to simultaneously generate and output the scan signals of all the stages.

17. The scan driver of claim 9, a time when the voltage level of the scan signal of the shift register is reversed in the sequential driving mode, is synchronized with a time when the third transistor turned on in response to the initial signal or the scan signal of the previous stage transfers a gate on voltage of the second clock signal.

18. The scan driver of claim 9, a time when voltage levels of all the scan signals of the shift register are reversed in the simultaneous driving mode, is synchronized with a time when the voltage levels of the first control signal and the second control signal simultaneously shift.

19. The scan driver of claim 1, a switching element included in the shift register is a PMOS transistor or an NMOS transistor.

20. A display device, comprising:

a display panel including a plurality of pixels connected to a plurality of scan lines to which a plurality of scan signals are transferred and a plurality of data lines to which a plurality of data signals are transferred;

a scan driver generating and transferring the scan signal to a corresponding scan line among the plurality of scan lines; and a data driver transferring data signals to the plurality of data lines, wherein the scan driver comprises:

a plurality of shift registers including an input signal terminal into which an initial signal or an output signal of a previous stage is inputted, two clock signal terminals to which 2 phase clock signals are transferred, two control signal terminals to which a first control signal and a second control signal controlling a driving mode of simultaneously driving or sequentially driving scan signals of all stages are transferred, and output signals terminals from which the scan signals are outputted, in the sequential driving mode, the first control signal and the second control signal are transferred as a predetermined first level voltage, in the simultaneous driving mode, the first control signal and the second control signal are transferred only alternately as the predetermined first level voltage and a predetermined second level voltage, and a corresponding row is selected from a plurality of pixel rows by a scan signal among the scan signals and the data signals are transferred in the selected corresponding row.

21. The display device of claim 20, the first level voltage is in a gate off voltage level and the second level voltage is in a gate on voltage level.

22. The display device of claim 20, the first control signal and the second control signal are not overlapped with each other in the simultaneous driving mode.

23. The display device of claim 20, signals transferred to the input signal terminal and the clock signal terminal are voltages having the gate off level in the simultaneous driving mode.

24. The display device of claim 20, when duty rates of the scan signals are outputted with an n-time horizontal cycle (n×H), the number of the clock signals is 2n where n being a natural number.

25. The display device of claim 24, the scan signals are overlapped with each other by an n−1-time horizontal cycle ((n−1)×H).

26. The display device of claim 20, two clock signals transferred to two clock signal terminals have a phase difference from each other by a half cycle.

27. The display device of claim 20, the shift register comprises:

a first transistor transferring a voltage corresponding to the initial signal or the scan signal of the previous stage when being turned on in response to a first clock signal;

a second transistor transferring a first power supply voltage as the scan signal of the sequential driving mode when being turned on in response to the first clock signal;

a third transistor transferring a voltage depending on a second clock signal as the scan signal of the sequential driving mode when being turned on by receiving the voltage corresponding to the initial signal or the scan signal of the previous stage;

a fourth transistor transferring the first power supply voltage as the scan signal of the simultaneous driving mode when being turned on in response to the first control signal;

a fifth transistor transferring a second power supply voltage having a voltage value lower than the first power supply voltage when being turned on in response to the second control signal; and a sixth transistor transferring the second power supply voltage as the scan signal of the simultaneous driving mode when being turned on by receiving the second power supply voltage.

28. The display device of claim 27, the shift register further comprises:

a first capacitor connected between a gate terminal and a drain terminal of the third transistor; and a second capacitor connected between a gate terminal and a drain terminal of the sixth transistor.

29. The display device of claim 27, the shift register generates the scan signal as a pulse of a voltage level depending on the first power supply voltage or the second clock signal in the sequential driving mode to sequentially generate and output the scan signals of all the stages.

30. The display device of claim 27, the shift register generates the scan signal as a pulse of a voltage level depending on the first power supply voltage or the second power supply voltage in the simultaneous driving mode to simultaneously generate and the scan signals of all the stages.

31. The display device of claim 27, a time when the voltage level of the scan signal of the shift register is reversed in the sequential driving mode, is synchronized with a time when the third transistor turned on in response to the initial signal or the scan signal of the previous stage transfers a gate on voltage of the second clock signal.

32. The display device of claim 27, a time when voltage levels of all the output signals of the shift register are reversed in the simultaneous driving mode, is synchronized with a time when the voltage levels of the first control signal and the second control signal simultaneously shift.

33. The display device of claim 27, the shift register further comprises:

at least two transistors connected between a first power supply to which the first power supply voltage is applied and a first node connected to a drain terminal of the first transistor and the gate terminal of the third transistor, and the two transistor are:

a seventh transistor transferring the first power supply voltage to the first node when being turned on in response to the first control signal; and an eighth transistor transferring the first power supply voltage to the first node when being turned on in response to the second control signal.

34. The display device of claim 33, the shift register turns off the seventh transistor and the eight transistor by transferring the first controls signal or the second control signal in a gate off voltage level in the sequential driving mode to sequentially generate and output the scan signals of all the stages.

35. The display device of claim 27, the shift register in the simultaneous driving mode to simultaneously generate and output the scan signals of all the stages, generates the scan signal in the gate off voltage level in response to the first control signal applied in a gate on voltage level, and generates the scan signal in the gate on voltage level in response to the second control signal applied in the gate on voltage level.

36. The display device of claim 20, a switching element included in the shift register is a PMOS transistor or an NMOS transistor.

* * * * *